US007762913B1

(12) United States Patent
Hagen et al.

(10) Patent No.: US 7,762,913 B1
(45) Date of Patent: Jul. 27, 2010

(54) BAT TRAINING DEVICE

(75) Inventors: Garrett Brian Hagen, Wexford, PA (US); Brian F. Hagen, Wexford, PA (US); Theodore F. Cataldi, Jr., McKees Rocks, PA (US)

(73) Assignee: For You, Inc., McKees Rocks, PA (US)

( * ) Notice: Subject to any disclaimer, the term of this patent is extended or adjusted under 35 U.S.C. 154(b) by 0 days.

(21) Appl. No.: 12/387,424

(22) Filed: May 1, 2009

(51) Int. Cl.
*A63B 69/00* (2006.01)

(52) U.S. Cl. ..... 473/457; 482/109; 482/121

(58) Field of Classification Search ..... 473/457, 473/519, 520, 564–568; 482/109, 121
See application file for complete search history.

(56) References Cited

U.S. PATENT DOCUMENTS

| | | | | | |
|---|---|---|---|---|---|
| 430,388 | A * | 6/1890 | Kinst | 473/564 |
| 838,257 | A * | 12/1906 | Kinst | 473/564 |
| 2,134,451 | A * | 10/1938 | Mogren | 482/94 |
| 3,554,545 | A * | 1/1971 | Mann et al. | 473/564 |
| 3,618,942 | A * | 11/1971 | Bates et al. | 482/129 |
| D263,863 | S * | 4/1982 | Golab | D21/725 |
| 4,328,964 | A * | 5/1982 | Walls | 482/129 |
| D325,612 | S * | 4/1992 | Longo | D21/725 |
| 5,269,511 | A * | 12/1993 | Chavez | 473/457 |
| 5,269,512 | A * | 12/1993 | Crowson et al. | 473/457 |
| 6,949,035 | B1 * | 9/2005 | Halsworth | 473/453 |
| 2005/0272537 | A1 * | 12/2005 | Kramer | 473/568 |
| 2007/0184924 | A1 * | 8/2007 | Burt | 473/549 |
| 2008/0064536 | A1 * | 3/2008 | Battaglino | 473/457 |

* cited by examiner

*Primary Examiner*—Mark S Graham
(74) *Attorney, Agent, or Firm*—Clifford A. Poff; Suzanne Kikel

(57) ABSTRACT

A truncated bat training device provides for training of the muscles and muscular strengthening of certain parts of the trainee's body. The bat has a 45 degree angle portion with a rotatable D-ring for attaching the bat to a fixed point. The angle portion projects to the backside of the upper body of the trainee and is turned toward the fixed point when the trainee swings the bat in a backward motion of a swing cycle in a resistance training mode. The angle portion provides a transition zone in which the D-ring rotates as the bat crosses perpendicular to the upper body allowing the trainee's wrist to accelerate with a ball at a simulated impact point where the trainee normally makes contact with the ball upon completion of the swing cycle. A ridge line teaches proper hand alignment, and several training techniques can be used with the training device.

20 Claims, 6 Drawing Sheets

BAT TRAINING DEVICE

FIELD OF THE INVENTION

The present invention relates to a training device, and more particularly, to a bat-like implement training device for multi-training aspects in preparation for a player hitting a ball.

BACKGROUND INFORMATION

The training bat devices of the prior art are designed for one of two purposes; either to train the muscles to swing the bat correctly or to develop the muscles to improve batting strength and velocity. General batting practice using a pitcher or a pitching machine is at times inefficient particularly with newer players who may not be able to even hit the ball. In this instance, the batter receives little accuracy or muscle strength training. A pitching machine does not add any resistance to the swing and does not strengthen the muscles to provide a more powerful swing. Examples of training devices of the prior art include those disclosed in U.S. Pat. Nos. 6,949,035 to Halsworth; 6,050,908 to Muhlsen; 6,030,299 to Denny; 5,595,384 to Hardison, Jr.; and 5,014,984 to Brockhoff.

U.S. Pat. No. 6,949,035 to Halsworth discloses a power swing training device that provides training and strengthening. The device is adjustable as to the direction or angle of the swing or by adding additional weights to gradually increase the body strength. This device provides a truncated training bat or other sports devices such as a tennis racquet, a golf club or a hockey stick.

U.S. Pat. No. 6,050,908 to Muhlsen discloses a training bat having a handle member with a shock absorbing coupler and a detachable elongated contact surface member coupled in the shock absorbing coupler. The detachable elongated contact surface member has a width significantly less than the width of a regular bat in order to enhance the eye-to-hand coordination to contact a pitched ball.

U.S. Pat. No. 6,030,299 to Denny discloses a suspended ball held by a flexible, resilient plate giving resistance to the batter's swing. The baseball teaching device allows the development of striking skills of a player by emulating a force with which a ball travels before being hit by a player.

U.S. Pat. No. 5,595,384 to Hardison, Jr. discloses a bat swing guide, which includes a vertical support member and an arcuate guide attached at one end to the vertical support member. The arcuate guide may be positioned to accommodate a right handed or left handed hitter. A pivoting tee is attached to the vertical support member for supporting the ball and an adjustable bat stop is attached to the arcuate guide.

U.S. Pat. No. 5,014,984 to Brockhoff discloses a practice baseball bat with an elongated shaft having a hand-grip portion at one end and an elongated enlarged cylindrical ball contact portion extending intermediate the ends of the shaft and adjacent the other end of the shaft. The hand-grip portion has a plurality of spaced apart and aligned raised portions which extend between the fingers of a batter's hands so that when the bat is swung, the raised portions will be moved from a first up position to a position in the direction of which the bat is swung.

One or more of these prior art devices may provide a training and/or a strengthening device. However, these prior art devices are generally mechanically complex and costly to build. Additionally, none of these prior art devices provides a bat training device specifically designed to properly train a batter in developing maximum resistance and wrist speed or wrist snap at the proper impact site when hitting a ball. Furthermore, none of these prior art devices provides a bat training device which contains a ridge line for proper hand placement around the bat.

SUMMARY OF THE INVENTION

The present invention provides a bat training device for multi-training aspects including training the muscles of a trainee so as to properly swing a bat and for muscular strengthening of specific parts of the trainee's body, for example, the upper body, hips and torso of the trainee; and/or for developing rotating muscles specific to a sport associated with the bat, for example, baseball, softball, and cricket.

In certain embodiments of the invention, the bat training device includes a truncated bat used to train a player to swing a bat for hitting a ball associated with a sport. The truncated bat has a shaft with a longitudinal axis defining a distal end and a proximal end for gripping the bat. The distal end has a rotatable attachment ring for the attachment of the bat to a fixed attachment point, and terminates along the shaft in an angle portion relative to the longitudinal axis of the bat. In certain embodiments of the invention, the truncated bat is affixed to the fixed attachment point via a resistance device, for example, a resistance band. In certain embodiments of the invention, the angle portion is at a 45 degree angle and is adapted to project to the backside of the upper body part of the trainee and is turned toward the fixed attachment point when the trainee swings the bat in a backward motion for a swing cycle of the bat for a resistance training mode. The 45 degree angle portion is also adapted to provide a transition zone in which the rotatable attachment ring rotates as the rotatable attachment ring crosses perpendicular to the upper body part of the trainee to allow the wrist of the trainee to accelerate through the ball at a simulated impact point at which the trainee would normally make contact with a ball upon completion of the swing cycle of the bat, while simultaneously increasing the tension as the attached resistance band is lengthened in the swing cycle of the bat.

In certain embodiments of the invention, the rotatable attachment ring is a D-ring.

In certain embodiments of the invention, the 45 degree angle portion of the bat and the positioning of the rotatable attachment ring on the 45 degree angle portion of the bat have a correlation wherein the rotatable attachment ring is allowed to move freely throughout a proper swing cycle of the bat thereby training the trainee or player in acquiring maximum resistance and wrist speed or wrist snap at the proper impact site when hitting the ball while simultaneously developing the rotating muscles specific to a sport.

In certain embodiments of the invention, the shaft of the bat includes a projected ridge line which is located along the backside of the shaft for teaching proper hand alignment of the trainee around the shaft of the bat prior to swinging the bat. The projected ridge line extends parallel to the longitudinal axis of the shaft of the bat.

In certain embodiments of the invention, the bat training device includes an elastic resistance band which is attached at its one end to the rotatable attachment ring and to a fixed anchor point at its other end for providing inertial force against the rotation of the rotatable attachment ring as the bat crosses perpendicular to the upper body part of the trainee.

It is therefore an object of the invention to provide a bat-like implement training device for multi-training aspects in preparation for a player hitting a ball.

It is a further object of the invention to provide a bat training device which trains the muscles so that the trainee automatically holds the bat and swings the bat properly while at the same time strengthening specific parts of the trainee's body, for example, the upper body, hips and torso of the trainee.

It is a still further object of the present invention to provide a bat training device for developing rotating muscles specific to a sport.

A still further object of the present invention is to provide a bat training device which is simple in construction and inexpensive to manufacture.

These and other objects and advantages of the present invention will be more apparent from the following description when read in light of the accompanying drawings.

DETAILED DESCRIPTION

Figure 1:
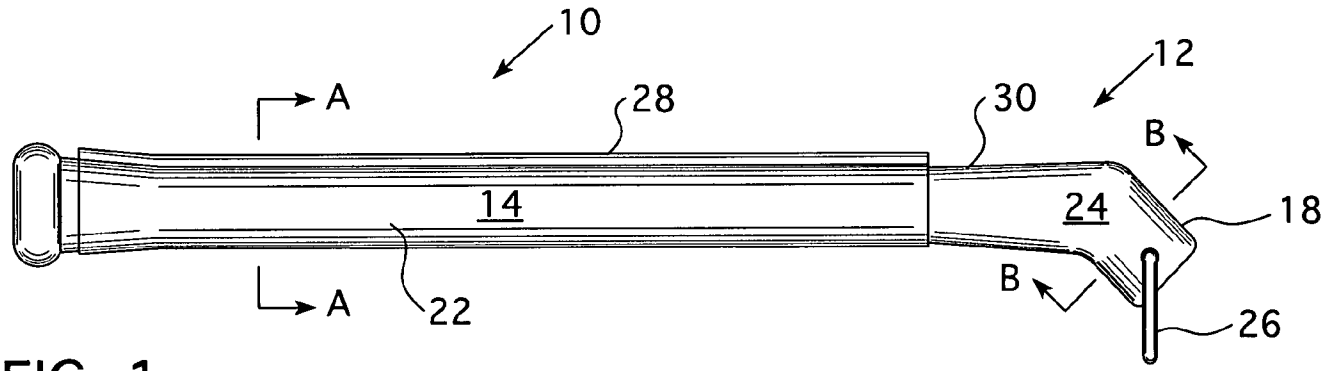
FIG. 1 is an elevation view of a bat training device of the present invention.
Figure 2:
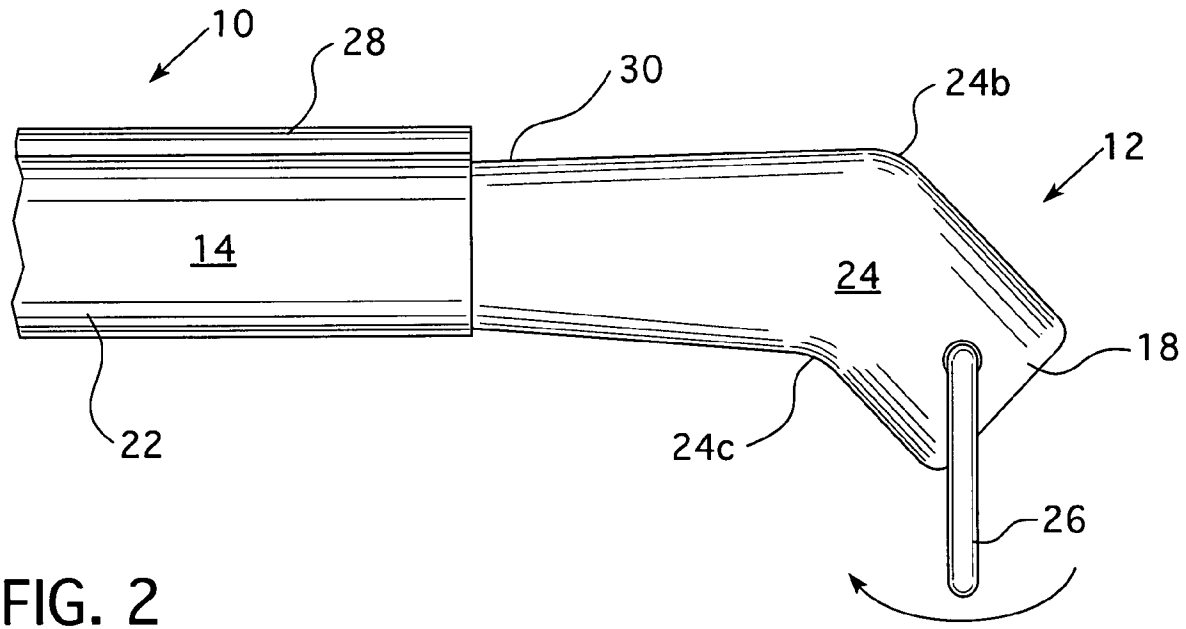
FIG. 2 is a partial, enlarged view of the bat training device of FIG. 1 showing a 45 degree angle portion with a rotatable attachment ring.
Figure 3:
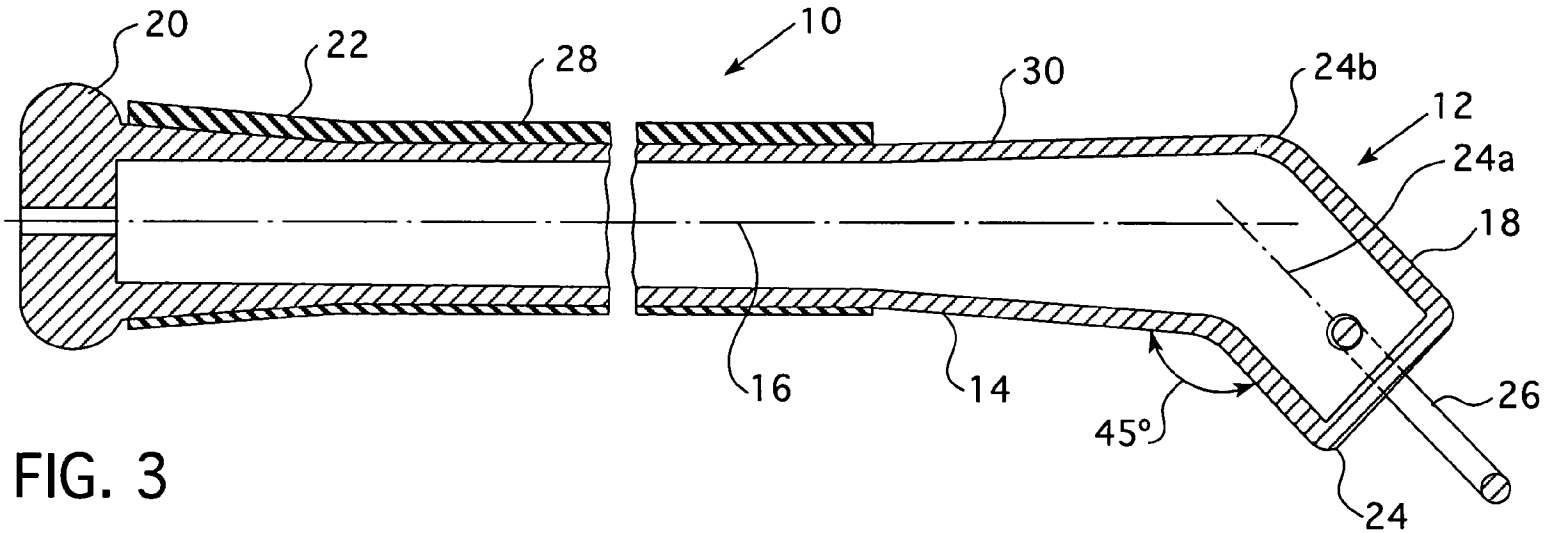
FIG. 3 is an enlarged sectional view of the bat training device of FIG. 1.

Referring now to the drawings, wherein like numerals refer to like and corresponding parts throughout the several views, in FIGS. 1, 2, and 3 a tethered, truncated bat training device is designated overall by the reference numeral 10. Bat training device 10 includes a bat-like implement or bat 12 having a shaft 14 with a longitudinal axis 16 indicated best in FIG. 3. Bat 12 further includes a distal end 18 and a proximal end 20. The proximal end 20 has a gripping portion 22 for gripping the shaft 14 by a trainee or player and the distal end 18 terminates along the shaft 14 at a 45 degree angle portion 24 of the shaft 14 relative to the longitudinal axis 16 of shaft 14 (FIG. 3). With particular reference to FIG. 3, the longitudinal axis 16 of shaft 14 and the longitudinal axis 24*a* of portion 24 forms a 45 degree angle and this 45 degree angle portion 24 defines a bent area 24*b* in angle portion 24. Angle portion 24 further includes a rotatable attachment ring 26 for attaching bat 12 to a fixed point, more about which is discussed herein below. Bat training device 10 is tethered in that for operation of device 10, the distal end 18 of bat 12 is secured to a fixed point.

As shown in FIGS. 1, 2 and 3, angle portion 24 and shaft 14 are integrally formed as a one piece construction. This may be done through a plastic injection molding process or other appropriate processes well known to those skilled in the art. Alternatively, shaft 14 and angle portion 24 may be separate pieces wherein angle portion 24 may be wedged onto shaft 14 and then welded to bat 12 through appropriate means known to those skilled in the art. As shown in FIGS. 1-3, gripping portion 22 is a separate piece from shaft 14 and mounted around shaft 14. Gripping portion 22 may be made of a pliable, soft thermoplastic or rubberized material and preferably has an embossed pattern for providing friction. Gripping portion 22 takes the form of a piece of material which is wrapped around shaft 14 with the opposed ends overlapping along the shaft 14 and secured together.

Figure 4B:
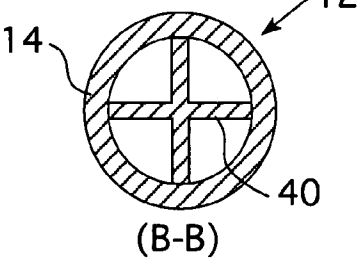
FIG. 4B is an enlarged sectional view taken along lines B-B of FIG. 1.
Figure 4A:
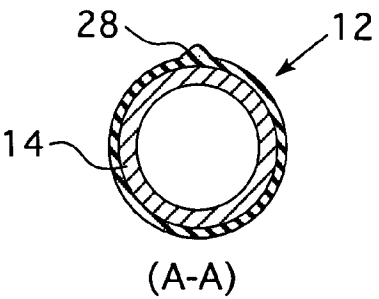
FIG. 4A is an enlarged sectional view taken along lines A-A of FIG. 1.

Referring to FIGS. 4A and 4B, the overlapping ends of the material forming gripping portion 22 are secured together to form a ridge line 28 as best shown in FIG. 4A. Even though ridge line 28 is formed by the overlapped ends of the material forming gripping portion 22, it is to be appreciated that ridge line may be integrally formed with shaft 14 in a plastic injection molding process or other appropriate processes for forming bat 12. If bat training device 10 is formed in an injection molding process then bat training device 10 will preferably be of a one-piece construction. In some embodiments of the invention, angle portion 24 may be reinforced by providing a cross member 40 in angle portion 24 as shown in FIG. 4B. In some embodiments of the invention, a reinforcement member may also be provided substantially along the entire length of shaft 14. It is to be appreciated that bat training device 10 may be made of a rigid, but yet, flexible material, for example, a thermoplastic polymer or a thermoset polymer, or it may be made of a metallic material, such as aluminum or light weight steel.

As best shown in FIGS. 1-3 ridge line 28 projects outwardly from and along the upper external surface 30 of shaft 14. Ridge line 28 is basically in the form of a raised longitudinal line that extends above and along surface 30 and parallel to the longitudinal axis 16 of shaft 14 as best shown in FIG. 3. As discussed herein above and as shown in FIGS. 1-3, ridge line 28 may be integrally formed with shaft 14. Alternatively, ridge line 28 may be welded onto shaft 14 through appropriate means if shaft 14 is made of a metallic material, such as light weight steel or aluminum. As discussed hereinabove, in an embodiment of the invention, ridge line 28 is formed by wrapping a soft, pliable thermoplastic or rubber material around shaft 14 and overlapping and affixing the opposed ends through appropriate means, for example, an epoxy. Ridge line 28 also extends in alignment with the bent area 24*b* of angle portion 24. That is, a straight line can be drawn from the end of ridge line 28 to the beginning of bent area 24*b* of angle portion 24 as best shown in FIG. 3. A main reason for providing ridge line 28 is to provide both visual feedback and tactile feedback to the trainee in order to teach proper hand alignment around shaft 14. Also, it is to be appreciated that ridge line 28 is located along the backside of bat 10 opposite to the direction in which bent area 24*b* of angle portion 24 extends.

Figure 5:
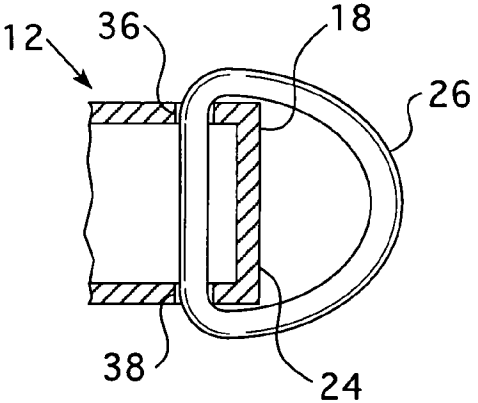
FIG. 5 is an enlarged sectional view showing the rotatable attachment ring assembled in the shaft of the bat training device of the present invention.

As best shown in FIG. 5, rotatable attachment ring 26 is a freely rotatable D-ring which extends through openings 36 and 38 located in angle portion 24. In an embodiment of the invention, D-ring 26 is secured within the distal end of angle portion 24 during the manufacturing process of bat 12. The length of the leg portions of D-ring are such as to adequately secure D-ring within angle portion 24 while at the same time limiting the axial movement of D-ring within angle portion 24. D-ring 26 may be made of metal, for example, light weight steel, brass, copper or aluminum, or it may be made of a flexible, but sturdy material, such as nylon grade plastic. It is to be appreciated that other suitable shaped rotatable rings may be used in the invention.

With reference again to FIGS. 1-3, while ridge line 28 is generally a guide for proper hand placement of the trainee on gripping portion 22, the embossed raised pattern of the material constituting gripping portion 22 provides sufficient friction for aiding in the retaining of the trainee's hands around gripping portion 22 of device 10 during the training sessions.

Figure 6:
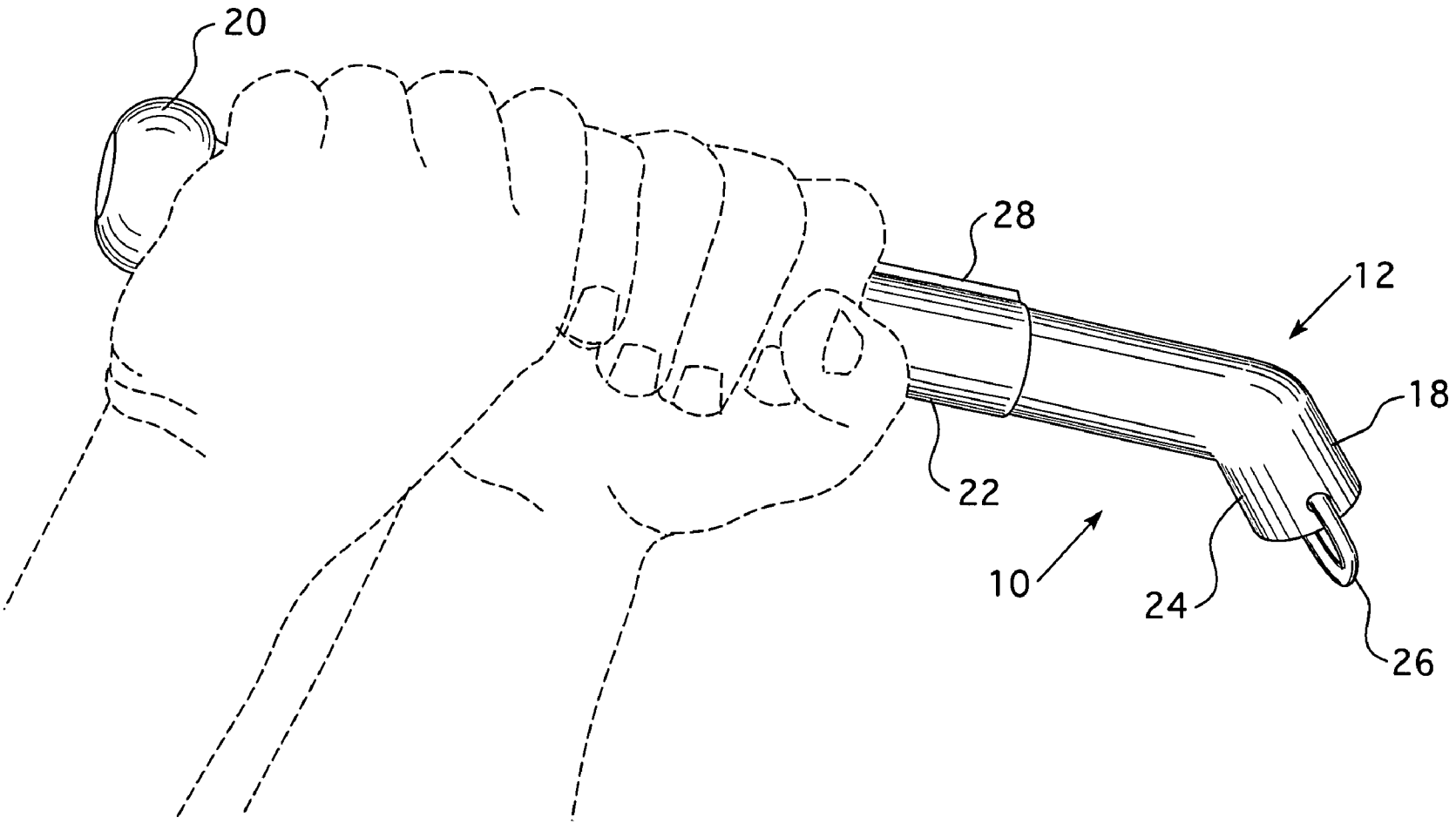
FIG. 6 is an illustration of the bat training device of the present invention being gripped by a trainee who is swinging the bat in a backward motion of a swing cycle in a resistance training mode.

FIG. 6 illustrates the placement of the trainee's hands around shaft 14 of device 10. As discussed herein above, ridge line 28 on the backside of shaft 14 is utilized for teaching proper hand alignment. In order to create additional bat speed and wrist speed or wrist snap at ball impact many trainers instruct the trainee or player to align the middle knuckles of the top and bottom hands along the bat prior to swinging. In this instance, ridge line 28 of bat 12 provides a quick reference or alignment site for the trainee as well as tactile feedback for properly aligning the middle knuckles, thereby reinforcing a proper batting technique as well as teaching muscle memory such that when a standard professional sports bat which does not contain a hand reference guide is actually held by the trainee or player, the player automatically places his or her hands into the proper positioning for to the swing, shown for example, in FIG. 6.

Referring again to FIGS. 1 and 3, training device 10 has proximal end 20. It is to be appreciated that proximal end 20 is generally rounded and smaller in diameter compared to the rounded end of a standard professional sport bat, particularly baseball and softball bats. This design is provided so that the proximal end 20 does not dig into or pinch the hands of the trainee during a swing cycle. In general, this design provides a comfortable transition zone when the trainee snaps his wrist when the bat impacts a ball. Thus, training device 10 does not contact and therefore does not dig into the tissue of the bottom hand which generally occurs with the present design of the standard professional sport bats and with the designs of many prior art bat training devices.

In some embodiments of the present invention, D-ring 26 is provided in order to attach and secure bat 12 to a fixed point for operation of the training device 10 by a trainee. This attachment of bat 12 may be accomplished via a resistance device, for example, a resistance band assembly 44 as illustrated in FIGS. 7A through 7E. Resistance band assembly 44 used in the invention may be a device well known to those skilled in the art. A suitable resistance band assembly 44 which may be used in the invention is disclosed in Column 4, lines 1-23 of U.S. Pat. No. 6,117,056 which portions are incorporated herein by reference. Resistance band assembly 44 includes a resistance band 43 and two snap hooks, one attached to each of the opposed ends of band 43. As shown in FIGS. 7A through 7E, a similar snap hook is shown at reference number 46 as being secured to D-ring 26. The snap hook at the other end of resistance band 43 which is not shown in FIGS. 7A through 7E may be attached to a suitable fixed point, such as, a fence, an upright post, or a batting cage.

An alternative arrangement for providing tension or resistance in bat 12 of training device 10 of the present invention may involve resistance band 43 having only one snap hook 46 secured to D-ring 26 and having a hand band at the opposed end of resistance band 43 as disclosed in Column 4, lines 24-33 of the aforementioned U.S. Pat. No. 6,117,056 which portions are incorporated herein by reference along with the relevant figures of this '056 patent. When using the resistance band of this alternative arrangement, a snap hook 46 will be secured to D-ring 26 and the hand band (not shown in the FIGS. 1-7E) may be anchored between a door jamb and a closed door of the trainee's practice room. FIGS. 7A through 7E show a suitable resistance band 43 cut away for brevity purposes. However, it is to be appreciated that resistance band 43 of FIGS. 7A through 7E is anchored at its opposite end at the same anchoring point or positioning via one of the techniques described herein above. It is to be further appreciated that other suitable techniques for anchoring or affixing resistance band 43 may be used with the bat training device 10 of the present invention.

The resistance band 43 of the elastic band assembly 44 of the invention may be one of several different resistance bands commercially available. Suitable bands providing the different levels of resistance are available in varying colors for easy identification of the resistance level are sold under the trademark DURABAND® which is a registered trademark of For You, Inc., McKees Rocks, Pa. the assignee of the present invention. Each resistance band is available in a color indicating a resistance ranging from about 1 lb/feet to about 60 lbs/feet. It is known that these resistance bands increase tension as the band is lengthened and that when the bands collapse or are shortened that no tension exists or the tension is decreased, respectively.

FIGS. 6, 7A, 7B, 7C, 7D, 7E and 7F show the several positioning of the hands and training device 10 of the present invention relative to a swing cycle of bat 12 for a training session referred to as a resistance training session (mode 1). For this resistance training session, resistance band 43 will initially be in a collapsed condition. FIG. 6 illustrates that bat training device 10 is positioned such that angle portion 24 is projected to the backside of the trainee and is turned toward the attachment point behind the trainee. This attachment point may be created by the band assembly 44 being anchored between the door jamb and the door in a closed door position, as discussed herein above.

As illustrated in FIGS. 7A through 7F, the design of angle portion 24 and D-ring 26 allow for a completely free movement or rotation of D-ring 26 during the resistance training session of the trainee. That is, the arrangement of angle portion 24 and D-ring 26 allows a full swing movement of bat 12 to occur thereby allowing the trainee to simulate full rotation of a swing cycle with resistance provided by band assembly 44 without angle portion 24 hindering movement or rotation of D-ring 26. These results are demonstrated in FIGS. 7A through 7E. Furthermore, as clearly demonstrated in FIGS. 7E and 7F, this construction of angle portion 24 and D-ring 26 provides a transition zone or wrist snap zone to occur at a proper point in the swing cycle, training the trainee to increase power and snap his or her wrist at ball impact when the trainee's body is turned or rotated in the correct direction as indicated by the hands in FIGS. 7E and 7F.

Figure 7A:
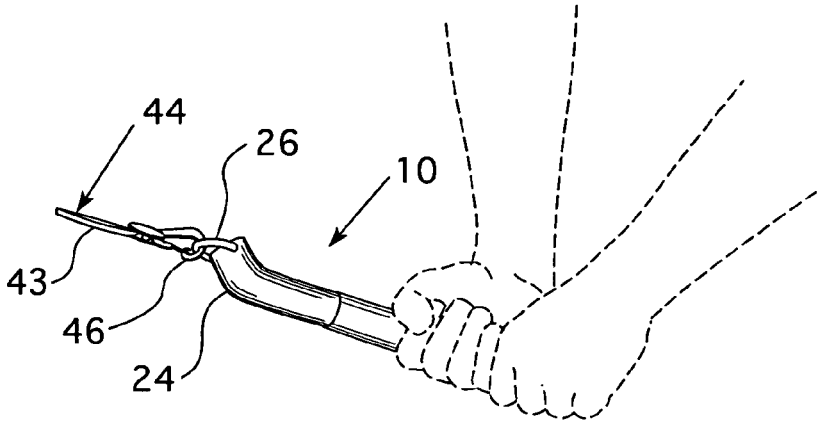
FIGS. 7A-7F are various perspective views illustrating the rotation of the rotatable attachment ring as the trainee proceeds from the positioning of FIG. 6 through the swing cycle for the bat training device of the present invention.
Figure 7B:
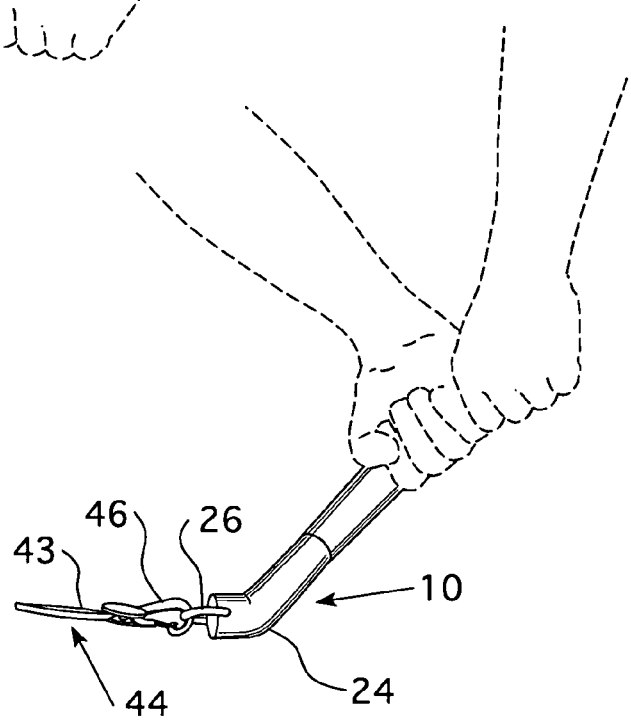
Figure 7C:
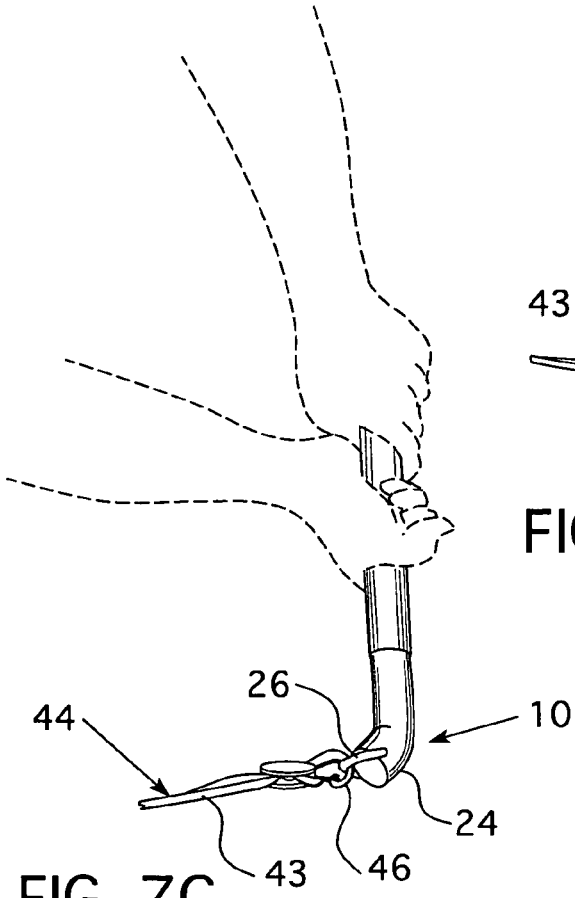
Figure 7D:
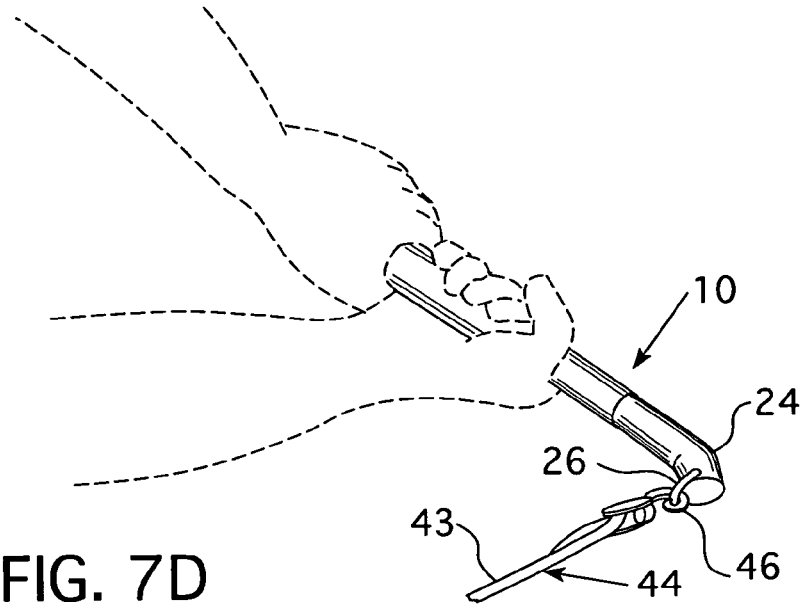
Figure 7E:
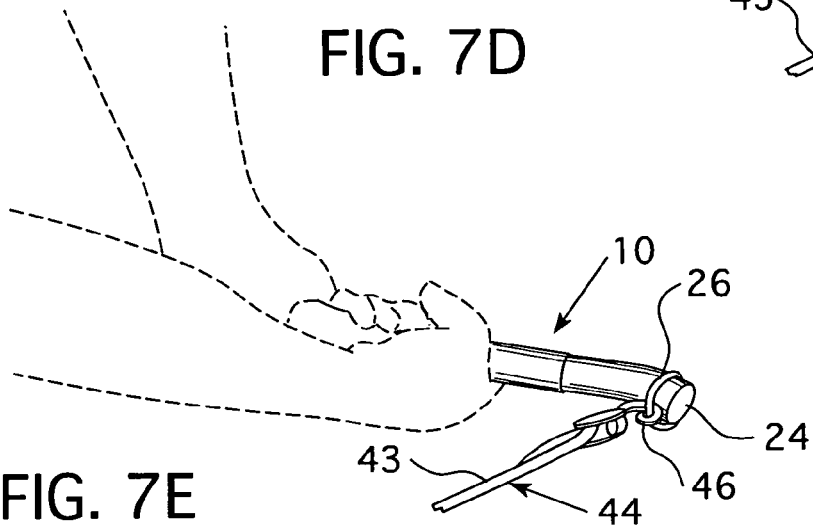
Figure 7F:
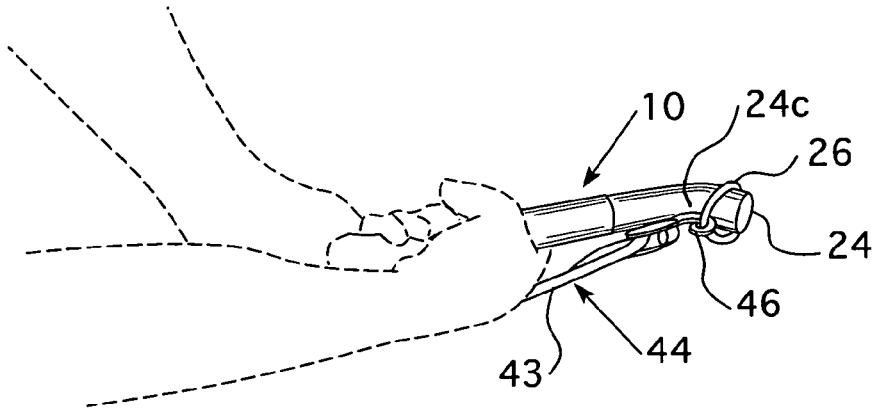

As shown in FIGS. 7A through 7F, angle portion 24, preferably at a 45 degree angle relative to the longitudinal axis 16 of bat 12, allows for a unique transition zone in which D-ring 26 rapidly rotates as it crosses perpendicularly to the front part of the trainee's body as particularly shown in FIGS. 7D-7F, allowing the trainee's wrist to accelerate or snap through the ball at the simulated impact point at which the trainee would normally make contact with the ball in an actual hitting of the ball by a standard professional baseball or softball bat. It is to be appreciated that during the resistance training session illustrated in FIGS. 7A through 7F, the resistance band assembly 44 is lengthened and then stretched providing a degree of resistance inherently existing in resistance band 43 as shown in FIGS. 7A through 7D. As D-ring 26 rotates and moves into inner bend 24*c* as shown in FIGS. 7E and 7F, the resistance provided by band 43 is no longer applied to training bat 10 bat in that band 43 collapses at this point due to the decrease in distance between D-ring 26 and the fixed point of resistance band 43, which as discussed herein above, may be provided by resistance band 43 being anchored between a door jamb and a closed door or being anchored to a batting cage or any other suitable anchoring point.

A further type of training which is made possible by the bat training device 10 of the present invention and which is not demonstrated in FIGS. 7A through 7F is referred to as an over speed training mode (mode 2). For this type of training session, initially bat training device 10 will be held by the trainee such that the 45 degree angle portion 24 and the attachment ring 26 along with the resistance band 43 would be projected across the front of the trainee's body. In this instance, resistance band 43 would be in a lengthened condition providing the maximum resistance available in the band. As the trainee completes the swing cycle, the resistance band 43 is shortened and its resistance is decreased. During the over speed training mode (mode 2), resistance band 43 provides assistance through the swing cycle thereby lessening the load or resistance of band 43 allowing the trainee to swing at a faster speed than he or she could normally generate otherwise. This type of training with the bat training device 10 of the present invention is designed to stimulate the trainee's brain and neuromuscular system, which in effect, stimulates faster muscle contraction; whereas the resistance training mode (mode 1) for bat training device 10 as described herein above strengthens the trainee's muscles, increases wrist snap or wrist speed, and teaches proper hand placement and alignment.

In the over speed training (mode 2), bat training device 10 is used with the resistance effect of resistance band 43 being applied in the opposite direction to that of the resistance training session described in herein above in that the swinging of bat 12 is assisted and not resisted to cause an over speed training effect whereby the muscles of the trainee are strengthened and firing speed of the trainee's neuromuscular system is increased. In both types of training sessions, i.e. the resistance training session and the over speed training session, the swinging of bat 12 is such that D-ring 26 rotates in the direction of arrow shown in FIG. 2 so that D-ring 26 is nestled within inward portion or inner bend 24*c* of angle portion 24 as shown in FIGS. 7E and 7F.

For both the resistance training mode (mode 1) of FIGS. 7A through 7F and the over speed training mode (mode 2), throughout the swing cycle of training bat 10, the angle portion 24 with D-ring 26 forces self-alignment of the wrist and the bat into the proper swing plane for building muscle memory for a proper swing. For this proper swing of training device 10, D-ring 26 generally will remain in a horizontal plane throughout the swing cycle with the snap hook 46 generally remaining in the middle region of D-ring 26 as shown in FIGS. 7A through 7F. If bat training device 10 is not properly swung then snap hook 46 will have a tendency to slide out of the middle region and to either side of D-ring 26.

Other practicing sessions or training techniques can be developed and applied in using the bat training device 10 of the present invention; however, the unique feature of the device 10 of the present invention is that D-ring 26 is permitted to freely rotate within the inner bend 24*c* in the direction of the arrow of FIG. 2 for a complete swing cycle of bat 12 regardless of the type of training technique being practiced by the trainee, e.g. mode 1 or mode 2 discussed herein above.

Figure 8:
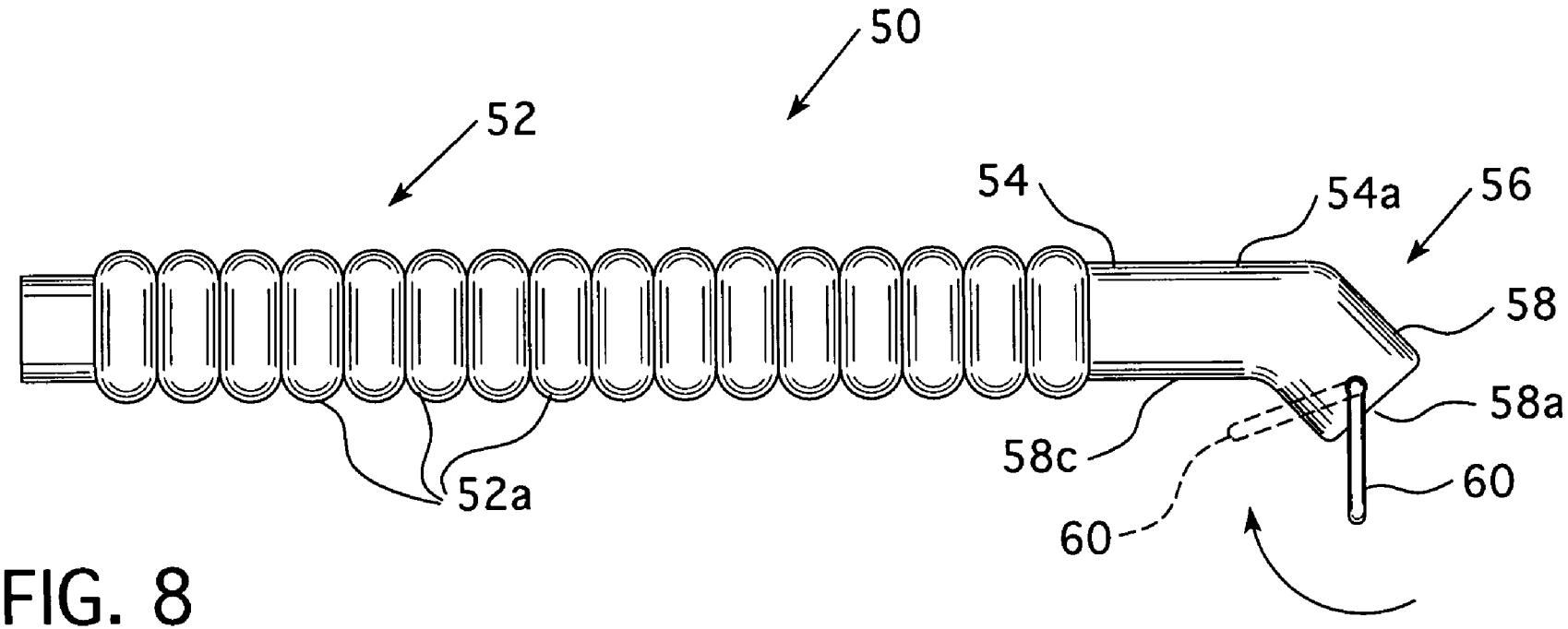
FIG. 8 is an illustration of a further embodiment of the bat training device of the present invention which can be used by a player in a practicing session for the sport of cricket.

FIG. 8 illustrates a further embodiment of the invention wherein bat training device 50 may be used for training sessions associated with a bat for use in the sport of cricket. In general, bat training device 50 has features that are similar to and that function similarly to that of bat training device 10 of FIGS. 1 through 7F. A difference in bat training device 50 is the gripping portion 52 which generally will not contain a ridge line for teaching proper positioning of the trainee's middle knuckles around shaft 54 of bat 56. A further difference is that the gripping material used for gripping portion 52 may be wrapped around shaft 54 in a helical fashion similar to a grip traditionally provided on tennis racquets, or as shown in FIG. 8 the gripping material for gripping portion 52 may contain several circular segments 52*a* along the length of gripping material as illustrated in FIG. 8. In this latter instance, the gripping material may be provided as a tube which is inserted around shaft 54 and then shrink fitted to tightly encircle the outer surface 54*a* of shaft 54 of bat 56. Gripping portion 52 may be made of a soft, pliable thermoplastic or rubber material. Notwithstanding these differences, the bat training device 50 includes an angle portion 58 and a rotatable attachment ring or D-ring 60 provided on angle portion 58 and which D-ring 60 rotates to move into position within the inner bend 58*c* of angle portion 58 similar to that of bat training device 10 of FIGS. 1 through 7F.

As shown in FIG. 8, a further difference would be in using bat training device 50 for training. In this respect, the bat training device 50 would be initially positioned toward the front of the trainee with the angle portion 58 pointing downwardly toward the ground and the distal end 58*a* of the angle portion 58 and the D-ring 60 being pointed away from the trainee. Here again, during a training session for the sport of cricket, rotatable D-ring 60 will rotate such that it is moved and nestled within the inner bend 58*c* of angle portion 58 at the end of the practice swing cycle as shown in phantom in FIG. 8 similar to that shown in FIG. 7F for bat training device 10. Similar to bat training device 10, angle portion 58 of training device 50 will preferably be angled at a 45 degree angle relative to the longitudinal axis of shaft 54 and the axis of angle portion 58. The overall outer diameter of shaft 54 may be slightly greater than that of shaft 14 of the bat training device 10 so as to provide more strength and stability to the bat training device 50.

It is to be appreciated that rotatable D-rings 26 and 60 of the embodiments of the present invention are structured such that there is sufficient clearance between the D-ring itself and the distal end of bats 12 and 56, respectively so that D-rings 26 and 60 are allowed to rotate pass the end of the distal end of its respective bat as shown particularly with reference to the embodiment of FIG. 7D so that D-rings 26 and 60 rotate and move into the inner bend 24*c*, 58*c* of angle portions 24 and 58, respectively as demonstrated in FIG. 7F. Even though the invention is disclosed with bat training devices 10 and 50 having an angle portion of 45 degrees, it is to be appreciated that angle portions 24 and 58 may have an angle less or greater than 45 degrees, the important part being that the respective D-ring is able to freely rotate to be positioned within the inner bend of the angle portion thereby extending the range of movement for D-ring 26, 60 relative to its respective shaft 14, 54 during the swing cycle.

A trainee or player using the training device 10 of the invention particularly when practicing the resistance training session described herein above, in general, will achieve muscle conditioning. Assuming a normal batting stance, the trainee, gripping the proximal end 20 of the bat 12 of the invention must apply force against the inertial tension in D-ring 26 which is provided by the resistance band assembly 44 affixed to a fixed attachment point. Repetitive motions by the trainee will produce both isotonic and/or isometric exercise for muscle groups in the shoulders, upper arms, forearms, stomach, thighs, and perhaps in the lower back/gluteus area, thus strengthening the upper and in some instance the lower parts of the body of the trainee. Additionally with regard to the bat training device 10 of the invention, muscle memory will allow the trainee to stand and hit the bat in a proper fashion and to replicate the same swing pattern to build the proper neural patterns and strength to accelerate bat speed. The device of the invention can be used with resistance in the opposite direction in which the swing is assisted and not resisted causing an over speed training effect thereby increasing muscle and neural firing speed as discussed herein above.

Even though a resistance band assembly has been described herein relative to the bat training device 10, it is to be appreciated that other resistance devices and/or arrangements, well—known to those skilled in the art, may be employed in the invention without distracting from the invention.

While the present invention has been described in connection with the embodiments of the various figures, it is to be understood that other similar embodiments may be used or modifications and additions may be made to the described embodiments for performing the same function of the present invention without deviating there from. Therefore, the present invention should not be limited to any single embodiment, but rather construed in breadth and scope in accordance with the recitation of the appended claims.

The invention claimed is:

1. A training device, comprising:

a truncated bat used to train a player to swing a bat, the truncated bat having a shaft with a longitudinal axis defining a distal end and a proximal end; the distal end having a rotatable attachment ring for the attachment of the bat to a fixed attachment point and the distal end terminating along the shaft at an angle portion of the bat relative to the longitudinal axis of the shaft; the angle portion of the bat adapted to project to the backside of the upper body part of the trainee and turned toward the attachment point when the trainee swings the bat in a swing cycle of the bat in a resistance training session; the angle portion of the bat comprising a bend in which the rotatable attachment ring rotates into as the rotatable attachment ring crosses perpendicular to the upper body part of the trainee to allow the wrist of the trainee to accelerate at a simulated impact point where the trainee would normally make contact with a ball upon completion of the swing cycle of the bat.

2. The training device of claim 1 wherein the rotatable attachment ring is a D-ring.

3. The training device of claim 1 wherein the angle portion is about a 45 degree angle portion and wherein the angle portion and the rotatable attachment ring on the angle portion have a correlation wherein the rotatable attachment ring moves freely throughout the swing cycle of the truncated bat thereby training the trainee in acquiring maximum resistance and wrist speed at the proper impact site when hitting the ball.

4. The training device of claim 1 wherein the shaft of the truncated bat includes a ridge line located on the backside of the shaft for proper hand alignment of the trainee around the shaft of the truncated bat prior to swinging the bat.

5. The training device of claim 4 wherein the ridge line extends parallel to the longitudinal axis of the shaft of the truncated bat.

6. The training device of claim 4 wherein the ridge line is located on the backside of the bat opposite to the extending direction of the bent area formed in the angle portion.

7. The training device of claim 1 further comprising a resistance device attached to the rotatable attachment ring of the truncated bat at its one end and to a fixed point at its other end for providing inertial force against the rotation of the rotatable attachment ring as the truncated bat crosses perpendicular to the body of the trainee.

8. The training device of claim 1 wherein the proximal end includes a gripping portion for gripping by the trainee.

9. The training device of claim 1 wherein the shaft and the angle portion are made of thermoplastic materials.

10. A training device, comprising:

a truncated bat used to train a player to swing a bat;

the truncated bat having a shaft with a longitudinal axis defining a distal end and a proximal end; the distal end having a rotatable attachment ring for the attachment of the bat to a fixed point and the distal end terminating along the shaft at an angle portion of the bat relative to the longitudinal axis of the shaft; the angle portion of the bat comprising a bend in which the rotatable attachment ring rotates into as the rotatable attachment ring crosses the body of the trainee to allow the wrist of the trainee to accelerate at a simulated impact point where the trainee would normally make contact with a ball upon completion of the swing cycle of the bat.

11. The training device of claim 10 wherein the rotatable attachment ring is a D-ring.

12. The training device of claim 10 wherein the angle portion is about a 45 degree angle portion and wherein the angle portion and the positioning of the rotatable attachment ring on the angle portion have a correlation wherein the rotatable attachment ring moves freely unobstructed throughout the swing cycle into the bend of the truncated bat thereby training the trainee in acquiring maximum resistance and wrist speed at the proper impact site when hitting the ball.

13. The training device of claim 10 wherein the shaft of the truncated bat includes a ridge line located on the backside of the shaft for proper hand alignment of the trainee around the shaft of the truncated bat prior to swinging the bat.

14. The training device of claim 10 further comprising a resistance device attached to the rotatable attachment ring at its one end and to a fixed point at its other end for providing inertial force against the rotation of the rotatable attachment ring as the truncated bat crosses perpendicular to the body of the trainee.

15. The training device of claim 10 wherein the proximal end includes a gripping portion for gripping by the trainee.

16. A training device, comprising:

a truncated bat used to train a player to swing a bat;

the truncated bat having a shaft with a longitudinal axis defining a distal end and a proximal end; the distal end having a rotatable attachment ring for the attachment of the bat to a fixed point and the distal end terminating along the shaft at an angle portion relative to the longitudinal axis of the shaft; the angle portion of the bat comprising a bend in which the rotatable attachment ring rotates and moves into upon completion of the swing cycle of the bat.

17. The training device of claim 16 wherein the rotatable attachment ring is a D-ring.

18. The training device of claim 16 wherein the angle portion is about a 45 degree angle portion and wherein the angle portion and the positioning of the rotatable attachment ring on the angle portion have a correlation wherein the rotatable attachment ring moves freely throughout the swing cycle of the truncated bat thereby training the trainee to properly swing the bat.

19. The training device of claim 16 wherein the shaft of the truncated bat includes a ridge line located on the backside of the shaft for proper hand alignment of the trainee around the shaft of the truncated bat prior to swinging the bat.

20. The training device of claim 16 further comprising a resistance device attached to the rotatable attachment ring at its one end and to a fixed point at its other end for providing inertial force against the rotation of the rotatable attachment ring as the truncated bat crosses the body of the trainee.

* * * * *